US006647236B2

(12) United States Patent
Katsuyama

(10) Patent No.: US 6,647,236 B2
(45) Date of Patent: Nov. 11, 2003

(54) TONER CONTAINER INCLUDING FOLDABLE CASE AND TONER REPLENISHING DEVICE USING THE SAME

(75) Inventor: Goro Katsuyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/157,881

(22) Filed: May 31, 2002

(65) Prior Publication Data

US 2002/0181973 A1 Dec. 5, 2002

(30) Foreign Application Priority Data

Jun. 1, 2001 (JP) ..... 2001-166684

(51) Int. Cl.[7] ..... G03G 15/08

(52) U.S. Cl. ..... 399/258; 141/364; 220/495.06; 399/262

(58) Field of Search ..... 399/258, 260, 399/262; 222/DIG. 1; D18/43; 141/364, 375; 220/495.05, 495.06; 225/117.3, 117.35

(56) References Cited

U.S. PATENT DOCUMENTS 3,385,500 A * 5/1968 Lavander ..... 222/DIG. 1
4,489,765 A * 12/1984 Yamada et al. ..... 222/DIG. 1
4,523,615 A * 6/1985 Feenstra et al. ..... 141/364
4,984,023 A * 1/1991 Yoshida ..... 399/262
6,304,739 B1 10/2001 Katsuyama et al.

FOREIGN PATENT DOCUMENTS

JP 2000-098720 4/2000
JP 2000-194182 7/2000

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A toner container of the present invention includes a rectangular, hollow case having a top wall, a bottom wall, two side walls facing each other and two end walls facing each other. The side walls and end walls each are formed with a thin portion at the intermediate position thereof, so that the case is foldable along such thin portions. An expandable, flexible pack is implemented as a gazette bag and received in the case. A bottom plate is affixed to the bottom inner surface of the case while a shutter member is mounted on the underside of the bottom plate. The case, pack, bottom plate and shutter member are formed with respective openings for toner discharge in corresponding positions. The shutter member selectively blocks or unblocks the opening of the bottom plate.

29 Claims, 6 Drawing Sheets

TONER CONTAINER INCLUDING FOLDABLE CASE AND TONER REPLENISHING DEVICE USING THE SAME

BACKGROUND OF THE INVENTION

1. Field of the Invention

The present invention relates to an image forming apparatus and more particularly to a toner container for an image forming apparatus and a toner replenishing device using the same.

2. Description of the Background Art

Generally, a toner container storing fresh toner is removably mounted to the body of a copier, printer, facsimile apparatus or similar electrophotographic image forming apparatus. Conventional toner containers have the following problems left unsolved.

A toner container cannot be easily crushed or disassembled when run out of toner and should therefore be transported in the same configuration as when it is full, resulting in inefficient transport. When pressured inside the toner container rises during operation due to, e.g., high ambient temperature, the toner in the toner container is apt to solidify. In addition, it is not easy for the operator to hold the toner container with hand or to mount it to an image forming apparatus, so that the toner container is sometimes mounted in an incorrect position.

Further, when the mouth of the toner container is opened by accident, the toner leaks to the outside or drops in a great amount at a time via the mouth. A substantial amount of toner remains in the toner container even after use. Moreover, the toner container is not highly productive or easy to refill. Improvements in such aspects as well as in the aspect of packing efficiency and stable quality are therefore desired.

Technologies relating to the present invention are disclosed in, e.g., Japanese Patent Laid-Open Publication Nos. 2000-98720 and 2000-194182.

SUMMARY OF THE INVENTION

It is an object of the present invention to provide a toner container improved in transport efficiency, disassembly, volume reduction, prevention of toner solidification, easiness of holding, mounting/dismounting efficiency, prevention of erroneous setting, toner replenishment, prevention of smearing, reduction of toner to remain, productivity, refilling ability, storing efficiency, prevention of accidental opening and so forth, and a toner replenishing device using the same.

A toner container of the present invention includes a rectangular, hollow case having a top wall, a bottom wall, two side walls facing each other and two end walls facing each other. The side walls and end walls each are formed with a thin portion at the intermediate position thereof, so that the case is foldable along such thin portions. An expandable, flexible pack is implemented as a gazette bag and received in the case. A bottom plate is affixed to the bottom inner surface of the case while a shutter member is mounted on the underside of the bottom plate. The case, pack, bottom plate and shutter member are formed with respective openings for toner discharge in corresponding positions. The shutter member selectively blocks or unblocks the opening of the bottom plate.

A toner replenishing device using the above toner container is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
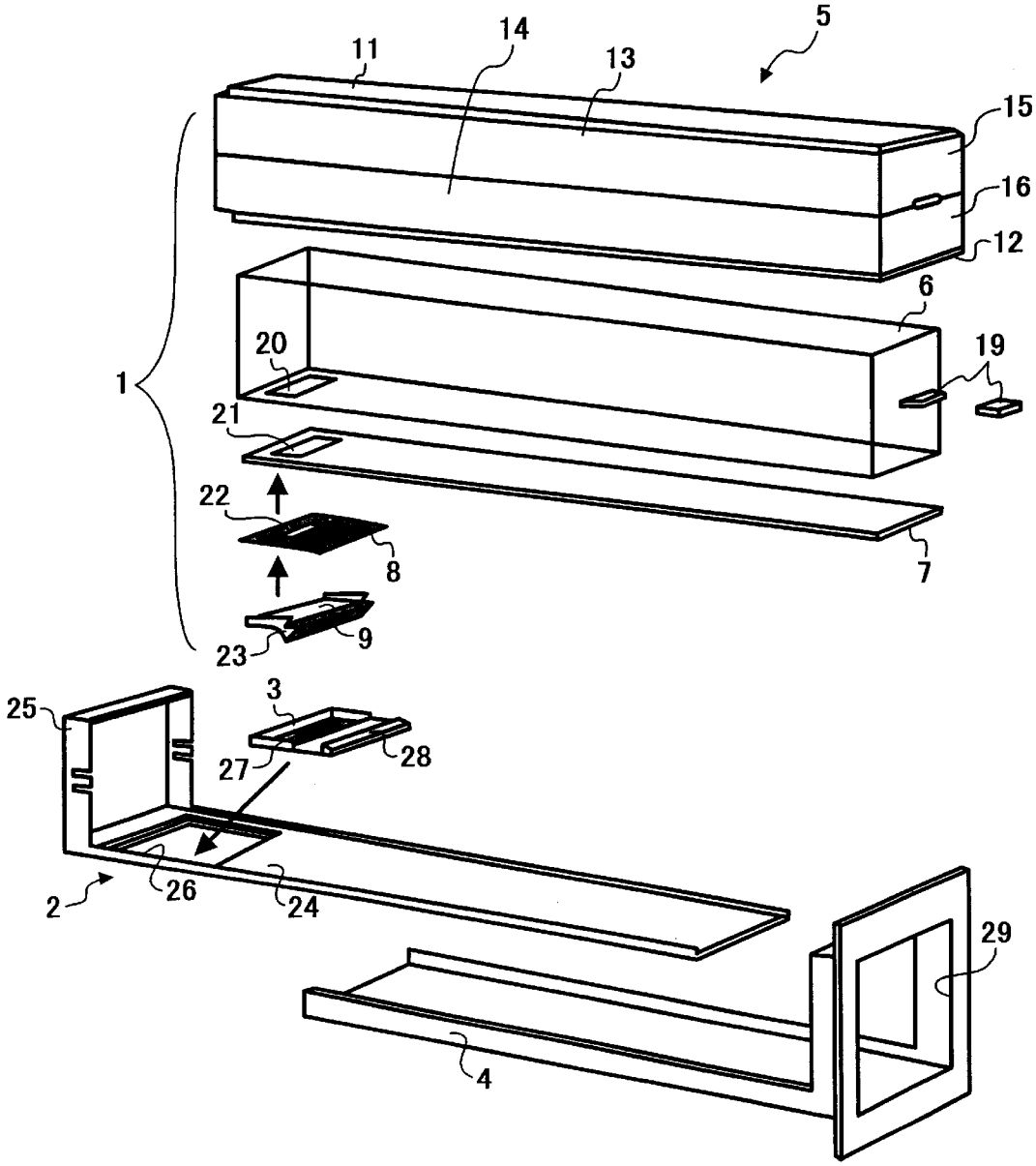
FIG. 1 is an exploded isometric view showing a toner container embodying the present invention and a toner replenishing device using the same.

Referring to FIG. 1 of the drawings, a toner container embodying the present invention and a toner replenishing device using the same are shown. The toner container, generally 1, is set on the toner replenishing device, which includes a tray 2 and a leaf spring 3. The reference numeral 4 designates a toner replenishing section included in the body of an image forming apparatus not shown.

The toner container 1 is made up of a case 5, a pack 6 resembling a gazette bag, a bottom plate 7, and a shutter member 9. The case 5 is a rectangular hollow box having 5 a top wall, a bottom wall, two side walls facing each other, and two end walls facing each other. The side walls and end walls each are formed with a thin portion at the intermediate position, so that the case 5 can be folded down at such thin portions. The pack 6 is formed of an expandable, flexible material and configured to be accommodated in the case 5. The bottom plate 7 is mounted on the bottom inner surfaces of the case 5. The shutter member 9 is mounted on the underside of the bottom plate 7 via a piece of sponge 8.

Figure 2:
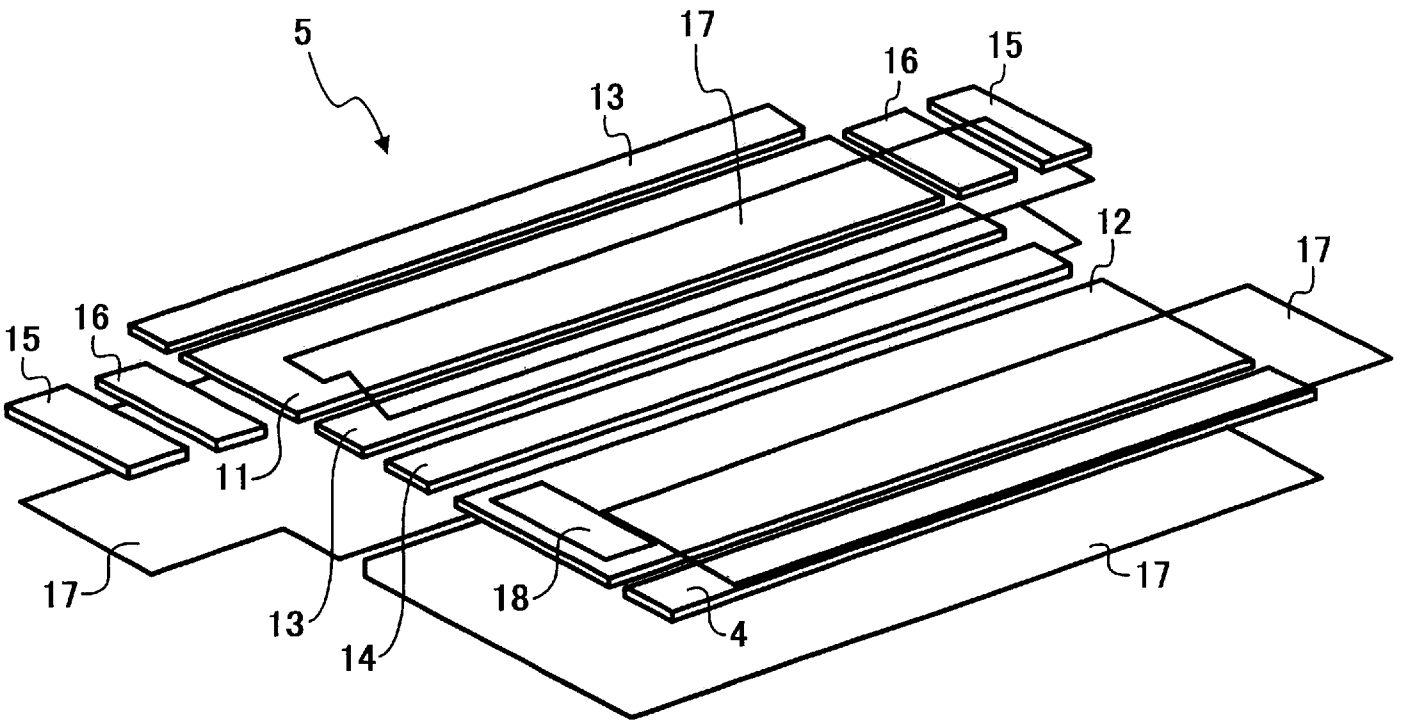
FIG. 2 is an exploded isometric view showing a case included in the toner container of the illustrative embodiment.

While the case 5 maybe implemented as a single member having a top wall, a bottom wall and four sides walls joined together via thin portions, such a member cannot be easily folded down in a thin, flat configuration, which will be described later. As shown in FIG. 2, in the illustrative embodiment, the case 5 includes a top wall 11 and a bottom wall 12 implemented as a single sheet each. A pair of side walls facing each other each are made up of an upper side sheet 13 and a lower side sheet 14. Likewise, a pair of end walls facing each other each are made up of an upper end sheet 15 and a lower end sheet 16. The individual sheets are welded together via welding sheets 17 positioned between them, so that the case 5 is foldable at its intermediate portions, as stated earlier. An opening or toner outlet 18 is formed in one end portion of the bottom wall 12. While the sheets constituting the case 5 may be formed of any suitable material, resin is desirable from the productivity and cost standpoint.

Figure 3A:
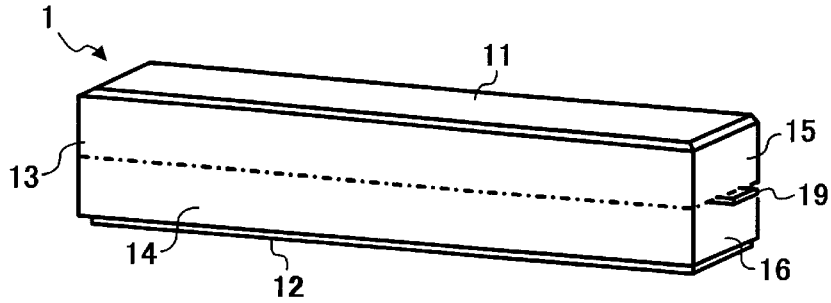
FIGS. 3A through 3D are isometric views demonstrating how the toner container of the illustrative embodiment is folded down.
Figure 3B:
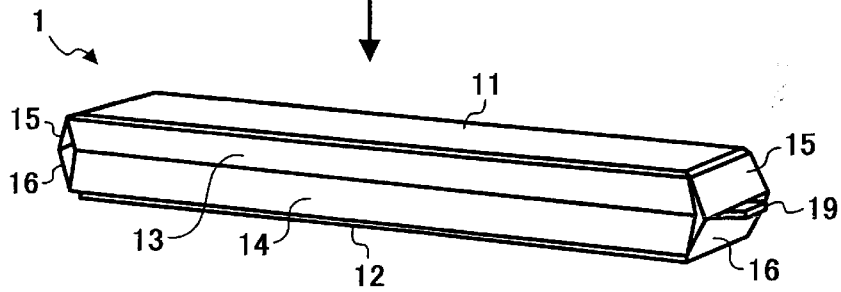
Figure 3C:
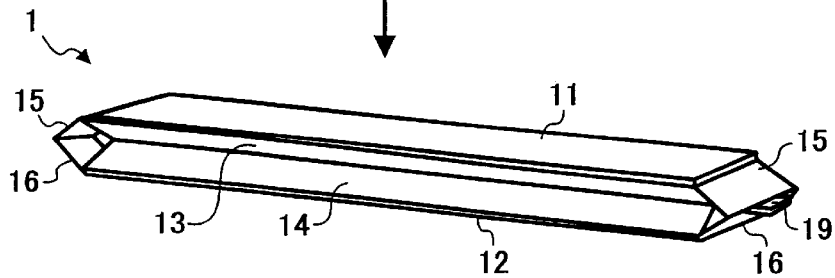
Figure 3D:
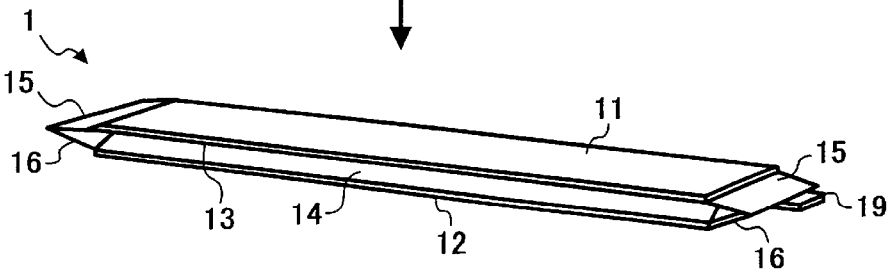

As shown in FIG. 3A, the case 5 is a rectangular, hollow box when framed while accommodating the pack 6 therein, as will be described specifically later. In this condition, a pull 19 affixed to the pack 6 protrudes from one end wall of the case 5, as illustrated. As shown in FIG. 3, when the pull 19 is pulled, the joints between the upper side sheets 13 and the lower side sheets 14 and the joints between the upper end sheets 15 and the lower end sheets 16 fold because the joints are implemented by the welding sheets 17. The case 5 is then folded down in a thin, flat configuration shown in FIGS. 3C and 3D. It is to be noted that the undersides, as seen in FIG. 2, constitute the inner surfaces of the case 5.

Ribs, notches or projections and recesses may be formed on the outer surfaces of the side walls of the case 5 in order to prevent the operator's fingers from slipping, although not shown specifically. Also, ribs may be formed on the outer surface of the bottom wall 12 for helping the operator recognize the top-and-bottom position of the case 5. This prevents the operator from mounting the case 5 to the toner replenishing section in an incorrect position. For the same purpose, the case 5 may be formed of a transparent material, so that the operator can directly see the color of toner stored in the case 5. To enhance easy mounting/dismounting, the upper side sheets 13 and lower side sheets 14 may be notched to allow the operator to easily grip the case 5. Also, to enhance sure gripping, at least the upper side sheets 13 and lower side sheets 14 may be formed of a hard material. Further, the entire outer periphery of the case 5 may be roughened or otherwise made irregular to make scratches inconspicuous when reused, contributing to the recycling of limited resources. In addition, all the walls of the case 5 may be formed of a hard material, so that the case 5 can be folded down flat and easily loaded and transported.

The pack 6 directly stores toner therein. In the illustrative embodiment, the pack 6 is implemented by transparent resin films connected together such that the side walls of the pack 6 are foldable like a gazette bag. An opening or toner outlet 20 is formed in one end portion of the bottom of the pack 6. The pull 19 mentioned earlier is welded to one end wall of the pack 6. Preferably, to obviate pin holes and other defects, the pull 19 should not be nipped between the above films, but should be welded to a portion of the pack 6 that will be flat when the pack 6 is assembled. The opening 20 corresponds in position to the opening 18 of the bottom wall 12 of the case 5. The pack 6 is formed of a material that can be folded down flat together with the case 5. The transparency of the pack 6 allows the operator to easily see the color of toner stored in the pack 6 although transparency is, of course, not essential. When temperature around the toner container 1 mounted to an image forming apparatus rises, pressure inside the pack 6 also rises and causes the pack 6 to expand. As a result, pressure inside the pack 6 is maintained substantially constant to thereby prevent the toner from solidifying.

The bottom plate 7 is formed of, e.g., hard resin and affixed to the surface of the bottom wall 12 of the case 5 that will constitute an inner surface. While the bottom plate 7 may, of course, be formed of metal, it should preferably be formed of resin from the light-weigh configuration and recycling standpoint. An opening or toner outlet 21 is formed in one end portion of the bottom plate 7 and corresponds in position to the opening 18 of the bottom wall 12. When the toner container 1 is disassembled, the bottom plate 7 is removed from the bottom wall 12. The image forming apparatus includes a feeding device, not shown, that causes the bottom plate 7 to vibrate in order to simplify the construction. The bottom plate 7 in vibration causes the toner to gather and drop into a toner hopper, not shown, via the opening 21.

The sponge 8 intervenes between the bottom plate 7 and the shutter member 9, as mentioned earlier. The sponge 8 plays the role of a seal for preventing the toner from leaking via the gap between the opening 21 of the bottom plate 7 and the shutter member 9, so that the toner is delivered only through the opening 22. The sponge 8 may, of course, be replaced with any other suitable material so long as it can serve as a seal.

The shutter member 9 is supported by the opposite side edges of the bottom plate 7 and slidable in the lengthwise direction of the bottom plate 7 to thereby selectively block or unblock the opening 21. The shutter member 9 should preferably be formed of metal or hard resin. A lug 23 protrudes from the underside of the shutter member 9 and is engageable with the leaf spring 3, which will be described later. When the toner container 1 is disassembled, the shutter member 9 can be easily removed only if it is slid along the side edges of the bottom plate 7.

The tray or toner replenishing device 2 is made up of a flat, case mount portion 24 capable of supporting the entire toner container, and a rectangular frame portion 25 for supporting the front end of the case 5. An opening 26 is formed in one end of the case mount portion 24 for delivering the toner discharged from the toner container 1 to an image forming section, not shown, included in the image forming apparatus. The leaf spring 23 is fitted in the opening 26 of the case mount portion 24. The leaf spring 23 includes an opening or toner outlet 27 and a lug 28 engageable with the lug 23 of the shutter member 9. To reduce the amount of toner to remain in the toner container 1 after use, the tray 2 should preferably be mounted to the toner replenishing section 4 in an inclined position such that one end of the case mount portion 24 adjoining the opening 26 is lower in level than the other end.

The toner replenishing section 4 includes an opening 29 for the ingress and egress of the toner container 1. The tray 2 is positioned inside the toner replenishing section 4.

It is to be noted that the in the assembled condition the openings 18, 20 through 22, 27 and 26 of the case 5, pack 6, bottom plate 7, sponge 8 and leaf spring 3 align with each other at their front edges in the direction of mounting, although not shown specifically.

Figure 4A:
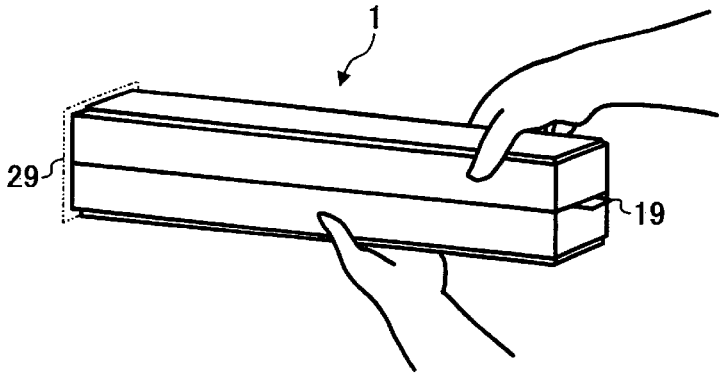
FIGS. 4A through 4D are isometric views showing how the toner container of the illustrative embodiment is mounted and dismounted from an image forming apparatus.
Figure 4B:
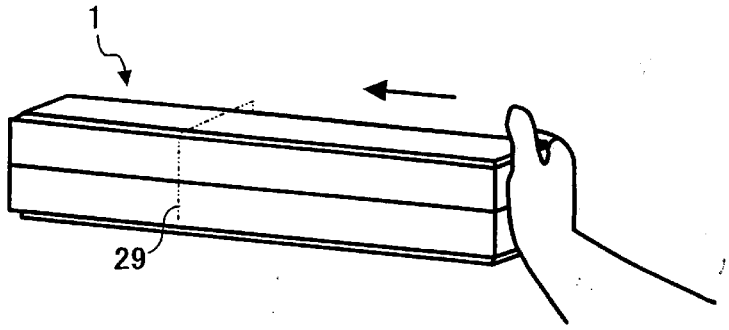
Figure 4C:
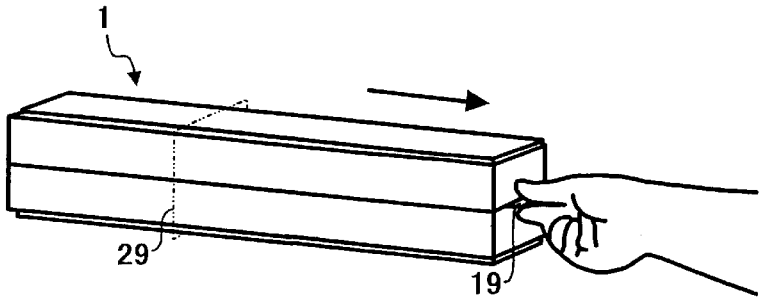
Figure 4D:
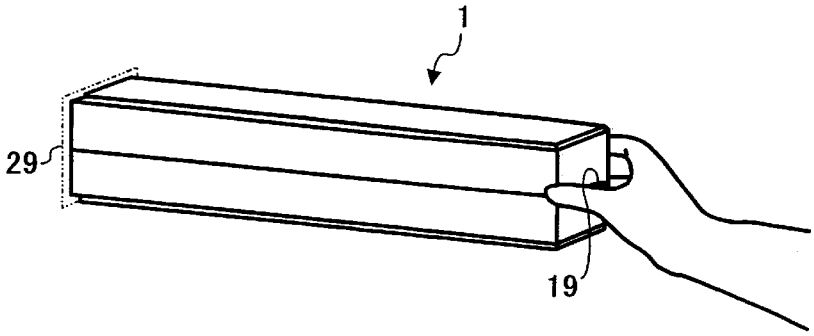

FIGS. 4A through 4D demonstrate how the toner container 1 is mounted and dismounted from the toner replenishing section 4. As shown in FIG. 4A, to mount the toner container 1, the operator positions the front end of the toner container 1 in the direction of mounting in the opening 29 of the toner replenishing section 4. The operator then pushes the rear end of the toner container 1 in the direction of mounting where the pull 19 protrudes into the toner replenishing section 4, as shown in FIG. 4B. As shown in FIG. 4C, to dismount the toner container 1 while reducing its volume, the operator nips the pull 19, then slowly pulls out the toner container 1 halfway, and then strongly pulls it out. As a result, the toner container 11 is folded down in the flat configuration shown in FIGS. 3B through 3D. If desired, as shown in FIG. 4D, the operator may hold the side walls of the toner container 1 pulled out halfway to the position shown in FIG. 4C and then fully pull out the toner container 1 without pressing it. This allows the toner container 1 to be dismounted without being reduced in volume.

Figure 5A:
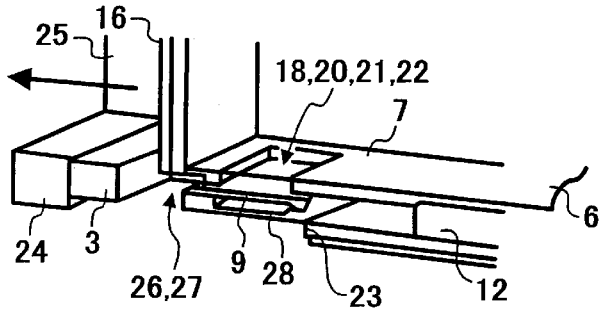
FIGS. 5A through 5D are isometric views showing how a shutter member unblocks the mouth of the toner container of the illustrative embodiment.
Figure 5B:
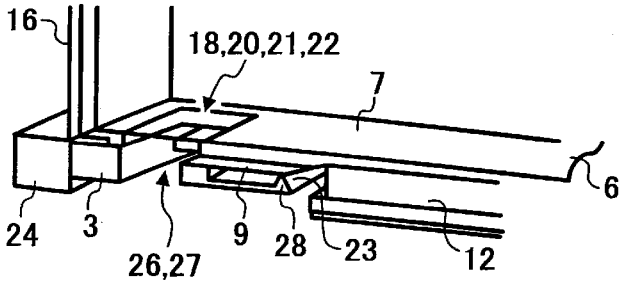
Figure 5C:
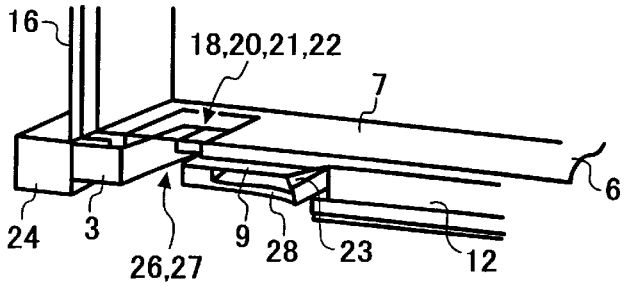
Figure 5D:
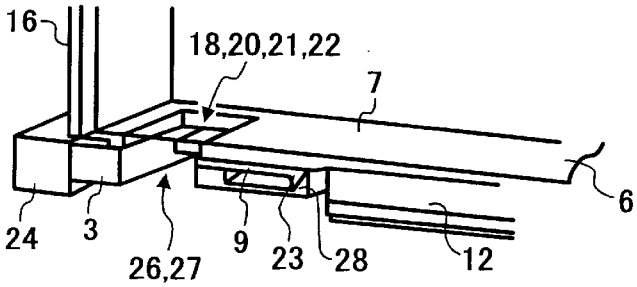

Reference will be made to FIGS. 5A through 5D for describing the interlocked operation of the shutter mechanism to occur when the toner container 1 is mounted to the image forming apparatus. Assume that the operator pushes the toner container 1 into the toner replenishing section 4 until the front end of the toner container 1 approaches the frame portion 25 of the case mount portion 24, as described with reference to FIGS. 4A and 4B. Then, as shown in FIG. 5A, the lug 23 of the shutter member 9 is caught by the lug 28 of the leaf spring 3. When the operator pushes the toner container 1 deeper into the toner replenishing section 4, the shutter member 9 does not follow the movement of the toner container 1 because of the engagement of the lugs 23 and 28. As a result, as shown in FIG. 5B, the shutter member 9 unblocks the openings 18 and 20 through 22 of the structural members of the toner container 1. When the operator pushes the toner container 1 further deeper into the toner replenishing section 4, the toner container 1 exceeds the movable range of the shutter member 9. Consequently, as shown in FIG. 5C, the shutter member 9 moves along with the toner container 1 until its lug 23 gets over the lug 28 and then stops. The toner container 1 is locked to the case mount portion 24 in the position shown in FIG. 5D. In this condition, all the openings 18, 20 through 22, 27 and 26 are unblocked in alignment with each other, so that the toner is replenished from the pack 6 to the hopper.

Figure 6A:
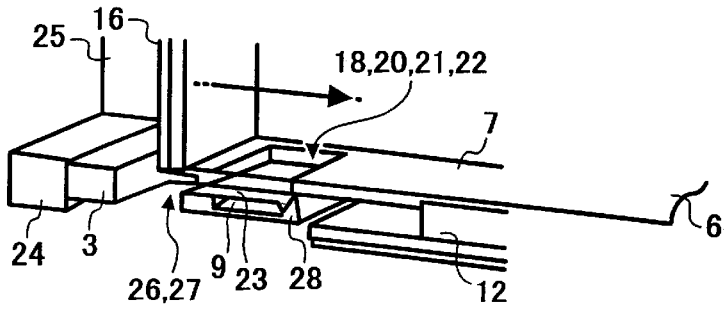
FIGS. 6A through 6D are views similar to FIGS. 5A through 5D, showing how the shutter member closes the mouth of the toner container of the illustrative embodiment.
Figure 6B:
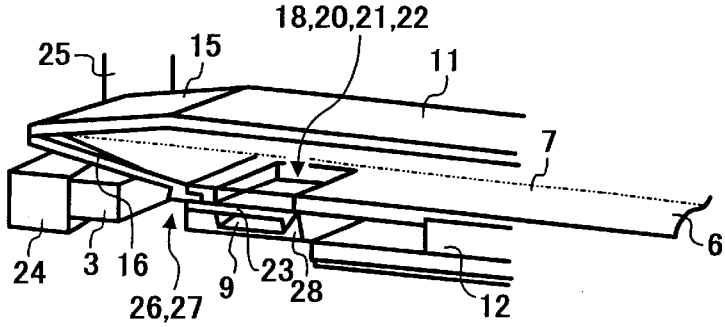

Reference will be made to FIGS. 6A through 6D for describing the interlocked operation of the shutter mechanism to occur when the toner container 1 is dismounted from the image forming apparatus. As shown in FIG. 4C, when the operator pulls the toner container 1 toward the outside of the toner replenishing device 4, the shutter member 9 cannot move because of the engagement of the lugs 23 and 28. As a result, as shown in FIG. 6A, the openings 18 and 20 through 22 move to the shutter member 9 and are blocked by the shutter member 9. That is, a time lag exists between the beginning of the pull-out of the toner container 1 and the operation of the shutter member 9. As shown in FIG. 6B, when the operator pulls the pull 19 further outward, the case 5 and pack 6 begin folding down, as described with reference to FIGS. 3A through 3D.

Figure 6C:
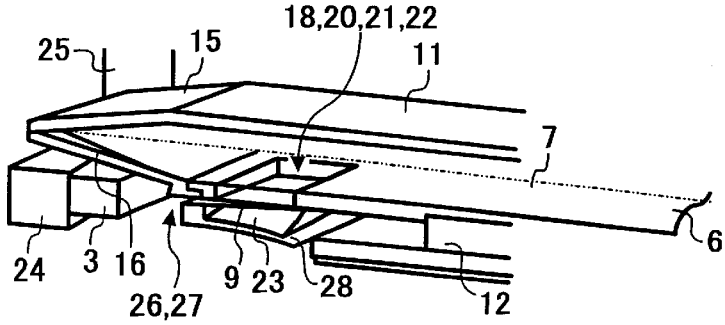
Figure 6D:
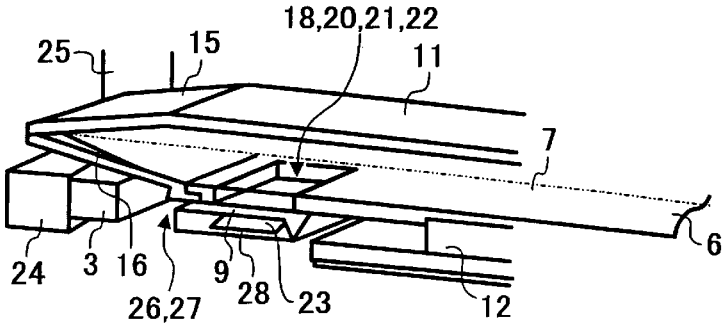

As shown in FIG. 6C, when the operator pulls the toner container 1 even more outward, the lug 23 abuts against the lug 28 to thereby cause the leaf spring 3 to deform. Subsequently, as shown in FIG. 6D, the lug 23 gets over the lug 28 in the direction opposite to the direction shown in FIG. 5C. In this condition, the operator can freely pull the entire toner container 1 out of the toner replenishing section 4. The shutter member 9 and leaf spring 3 cooperate with each other in the manner described even when the operator pulls out the toner container 1 without folding it down.

As stated above, the present invention prevents the shutter mechanism from being directly opened or closed from the outside and thereby obviates accidental opening or closing, which would cause the toner to be scattered and contaminate the environment. In addition, because the openings for the delivery of the toner are implemented as narrow slits, they prevent the toner from dropping in a great amount at a time and smearing the shutter mechanism.

In summary, it will be seen that the present invention provides a toner container and a toner replenishing device using the same having various unprecedented advantages, as enumerated below.

(1) The toner container can be easily folded down in a flat position and includes no projections. The toner container can therefore be efficiently transported and disassembled.

(2) Air inside the toner container is easily discharged when the toner container is folded down flat. Even when the toner container is in use, it can be pulled out without having its volume reduced for, e.g., the maintenance of an image forming apparatus. When pressure inside the toner container rises due to the elevation of temperature around the toner container, a pack included in the toner container expands to thereby maintain the pressure substantially constant.

(3) A shutter member is automatically opened or closed in interlocked relation to the movement of the toner container into and out of the image forming apparatus. This simplifies the construction of the toner replenishing device and obviates the accidental opening and closing of the toner container.

(4) The pack is implemented as a gazette bag that can be efficiently packed with toner.

(5) A toner outlet is positioned at one end portion of the toner container to thereby reduce the amount of toner to remain in the toner container.

(6) Ribs, notches or projections and recesses make it easy for the operator to hold the toner container.

(7) Ribs formed on the underside of a case and extending in the lengthwise direction of the case allow the operator to easily, surely recognize the top-and-bottom position of the toner container. This prevents the operator from setting the toner container in an incorrect position.

(8) A projection or a recess allows the operator to mount the toner container to the image forming apparatus in a correct position.

Various modifications will become possible for those skilled in the art after receiving the teachings of the present disclosure without departing from the scope thereof.

What is claimed is:

1. A toner container comprising:

a rectangular, hollow case having a top wall, a bottom wall, two side walls facing each other and two end walls facing each other, said side walls and said end walls each being formed with a thin portion at an intermediate position thereof to thereby allow said case to fold down at said thin portion;

an expandable, flexible pack implemented as a gazette bag and received in said case;

a bottom plate affixed to bottom inner surfaces of said case; and a shutter member mounted on an underside of said bottom plate;

wherein said case, said pack, said bottom plate and said shutter member are formed with respective openings for toner discharge in corresponding positions, and said shutter member selectively blocks or unblocks the opening of said bottom plate.

2. The toner container as claimed in claim 1, wherein the top wall, the bottom wall, the side walls and the end walls of said case comprise a single sheet each.

3. The toner container as claimed in claim 2, wherein said openings are positioned at one end portion of said toner container.

4. The toner container as claimed in claim 3, further comprising a pull affixed to one end wall of said case, wherein one end wall of said case is formed with an opening through which said pull protrudes.

5. The toner container as claimed in claim 4, further comprising at least one of ribs, notches and projections and recesses formed on an entire outer periphery of said case except for the end walls to thereby prevent operator's fingers from slipping.

6. The toner container as claimed in claim 5, further comprising ribs extending on the bottom walls of said case in a lengthwise direction of said case.

7. The toner container as claimed in claim 6, further comprising a projection or a lug for allowing said toner container to be mounted to an expected apparatus in a correct position.

8. The toner container as claimed in claim 1, wherein the top wall, the bottom wall, the side walls and the end walls of said case are separate from each other, and the side walls and the end walls each comprise an upper member and a lower member interconnected by a flexible sheet.

9. The toner container as claimed in claim 8, wherein the openings are positioned at one end portion of said toner container.

10. The toner container as claimed in claim 9, further comprising a pull affixed to one end wall of said case, wherein one end wall of said case is formed with an opening through which said pull protrudes.

11. The toner container as claimed in claim 10, further comprising at least one of ribs, notches and projections and recesses formed on an entire outer periphery of said case except for the end walls to thereby prevent operator's fingers from slipping.

12. The toner container as claimed in claim 11, further comprising ribs extending on the bottom walls of said case in a lengthwise direction of said case.

13. The toner container as claimed in claim 12, further comprising a projection or a lug for allowing said toner container to be mounted to an expected apparatus in a correct position.

14. The toner container as claimed in claim 1, wherein the openings are positioned at one end portion of said toner container.

15. The toner container as claimed in claim 14, further comprising a pull affixed to one end wall of said case, wherein one end wall of said case is formed with an opening through which said pull protrudes.

16. The toner container as claimed in claim 15, further comprising at least one of ribs, notches and projections and recesses formed on an entire outer periphery of said case except for the end walls to thereby prevent operator's fingers from slipping.

17. The toner container as claimed in claim 16, further comprising ribs extending on the bottom walls of said case in a lengthwise direction of said case.

18. The toner container as claimed in claim 17, further comprising a projection or a lug for allowing said toner container to be mounted to an expected apparatus in a correct position.

19. The toner container as claimed in claim 1, further comprising a pull affixed to one end wall of said case, wherein one end wall of said case is formed with an opening through which said pull protrudes.

20. The toner container as claimed in claim 19, further comprising at least one of ribs, notches and projections and recesses formed on an entire outer periphery of said case except for the end walls to thereby prevent operator's fingers from slipping.

21. The toner container as claimed in claim 20, further comprising ribs extending on the bottom walls of said case in a lengthwise direction of said case.

22. The toner container as claimed in claim 21, further comprising a projection or a lug for allowing said toner container to be mounted to an expected apparatus in a correct position.

23. The toner container as claimed in claim 1, further comprising at least one of ribs, notches and projections and recesses formed on an entire outer periphery of said case except for the end walls to thereby prevent operator's fingers from slipping.

24. The toner container as claimed in claim 23, further comprising ribs extending on the bottom walls of said case in a lengthwise direction of said case.

25. The toner container as claimed in claim 24, further comprising a projection or a lug for allowing said toner container to be mounted to an expected apparatus in a correct position.

26. The toner container as claimed in claim 1, further comprising ribs extending on the bottom walls of said case in a lengthwise direction of said case.

27. The toner container as claimed in claim 26, further comprising a projection or a lug for allowing said toner container to be mounted to an expected apparatus in a correct position.

28. The toner container as claimed in claim 1, further comprising a projection or a lug for allowing said toner container to be mounted to an expected apparatus in a correct position.

29. A toner replenishing device positioned at an open portion of a body of an image forming apparatus for allowing a toner container to be mounted to said body via said open portion, said toner container comprising:

a rectangular, hollow case having a top wall, a bottom wall, two side walls facing each other and two end walls facing each other, said side walls and said end walls each being formed with a thin portion at an intermediate position thereof to thereby allow said case to fold down at said thin portion;

an expandable, flexible pack implemented as a gazette bag and received in said case;

a bottom plate affixed to bottom inner surfaces of said case; and a shutter member mounted on an underside of said bottom plate;

wherein said case, said pack, said bottom plate and said shutter member are formed with respective openings for toner discharge in corresponding positions, and said shutter member selectively blocks or unblocks the opening of said bottom plate.

said toner replenishing device comprising:

a tray for allowing said toner container to be set thereon by being slid in a lengthwise direction of the top wall and the bottom wall of said case, said tray is formed with an opening corresponding in position to said openings of said toner container;

a leaf spring fitted in said opening of said tray and formed with an opening corresponding in position to said openings of said toner container, wherein said spring is formed with an engaging portion engageable with said shutter member for thereby moving said shutter member.

* * * * *